United States Patent [19]

McWilliams

[11] Patent Number: 4,892,997

[45] Date of Patent: Jan. 9, 1990

[54] ELECTRIC HEATERS

[75] Inventor: Joseph A. McWilliams, Droitwich, United Kingdom

[73] Assignee: Micropore International Limited, Worcestershire, England

[21] Appl. No.: 86,227

[22] Filed: Aug. 10, 1987

Related U.S. Application Data

[63] Continuation of Ser. No. 742,707, Jun. 7, 1985, abandoned.

[30] Foreign Application Priority Data

Jun. 9, 1984 [GB] United Kingdom ..... 8414764

[51] Int. Cl.[4] ..... H05B 3/74

[52] U.S. Cl. ..... 219/461; 219/464; 219/465

[58] Field of Search ..... 219/347, 348, 349, 354, 219/461, 464, 524, 540, 460, 465

[56] References Cited

U.S. PATENT DOCUMENTS

| | | | |
|---|---|---|---|
| 1,686,865 | 10/1928 | Klotz | 219/349 |
| 3,179,789 | 4/1965 | Gialanella | 219/349 |
| 3,271,874 | 9/1966 | Oppenheimer | 34/5 |
| 3,355,574 | 11/1967 | Bassett, Jr. | 219/464 |
| 3,363,090 | 1/1968 | Langley | 219/540 |
| 3,455,622 | 7/1969 | Cooper | 219/461 X |
| 3,612,828 | 10/1971 | Siegea | 219/464 |
| 3,663,798 | 5/1972 | Speidel et al. | 219/464 |
| 3,684,859 | 8/1972 | Deslodge | 219/354 |
| 3,714,885 | 2/1973 | Wertheimer et al. | 219/524 X |
| 3,987,275 | 10/1976 | Hurko | 219/461 |
| 4,296,311 | 10/1981 | Hagglund et al. | 219/464 |
| 4,388,520 | 6/1983 | McWilliams | 219/464 |
| 4,493,960 | 1/1985 | Mittelsteadt | 219/347 |

FOREIGN PATENT DOCUMENTS

| | | | |
|---|---|---|---|
| 102319 | 11/1937 | Australia . | |
| 0134090 | 3/1985 | European Pat. Off. . | |
| 440354 | 2/1927 | Fed. Rep. of Germany | 219/347 |
| 2164162 | 6/1973 | Fed. Rep. of Germany . | |
| 2809131 | 9/1979 | Fed. Rep. of Germany | 219/464 |
| 596954 | 11/1925 | France | 219/347 |
| 2138464 | 1/1973 | France . | |
| 2188106 | 1/1974 | France . | |
| 130439 | 4/1962 | New Zealand . | |
| 129054 | 8/1950 | Sweden | 219/461 |
| 432183 | 3/1935 | United Kingdom | 219/347 |
| 523374 | 7/1940 | United Kingdom | 219/347 |
| 1368346 | 9/1974 | United Kingdom . | |
| 2005824 | 9/1978 | United Kingdom . | |
| 2132060 | 6/1984 | United Kingdom | 219/464 |

*Primary Examiner*—Teresa J. Walberg
*Attorney, Agent, or Firm*—Browdy and Neimark

[57] ABSTRACT

An electric heater for a glass ceramic top cooker includes a base layer of thermal insulation material such as ceramic fiber or a microporous thermal insulation, a source of infra-red radiation such as a pair of infra-red lamps, and a reflector which is positioned so as to reflect infra-red radiation emitted by the source towards the layer of thermal insulation material. The reflector may be a specular reflector such as a coating of a reflecting metal deposited internally or externally of the source of infra-red radiation or may be a diffuse reflector such as a layer of fine particulate alumina deposited onto the external surface of the source of infra-red radiation.

19 Claims, 4 Drawing Sheets

(PRIOR ART)

ELECTRIC HEATERS

This is a continuation of application Ser. No. 742,707 filed June 7, 1985, now abandoned.

FIELD OF THE INVENTION

The present invention relates to electric heaters which incorporate a source of infra-red radiation and to electric cookers incorporating such heaters.

DESCRIPTION OF THE PRIOR ART

Electric cookers which incorporate infra-red radiation heaters are known, for example, from British Patent Specifications Nos. 1 273 023 and 1 406 028. Further, it is known from GB 1 406 028 to provide a reflective coating on the bottom half of the infra-red lamp which forms part of the heater so as to reflect infra-red radiation out of the heater. However, the provision of such a reflective coating can result in an unsatisfactory distribution of infra-red radiation from the heater giving rise to undesirably high temperatures adjacent to the or each lamp and can result in non-uniform heating and poor performance of the heater. This problem arises particularly when the infra-red lamp or lamps are confined to a relatively small area of the heater. A relatively even distribution of infra-red radiation can be achieved by arranging the lamp or lamps towards the bottom of a bowl-shaped heater. However, there is a demand for heaters to be as shallow as possible which restricts the application of such bowl-shaped reflectors.

OBJECT OF THE INVENTION

It is an object of the present invention to provide an electric heater which incorporates a source of infra-red radiation with a relatively even distribution of infra-red radiation issuing from the heater.

SUMMARY OF THE INVENTION

According to one aspect of the present invention there is provided an electric heater which comprises a source of infra-red radiation, a layer of thermal insulation material and a reflector positioned to reflect infra-red radiation emitted by the source towards the layer of thermal insulation material. The source of infra-red radiation may comprise one or more infra-red lamps. The layer of thermal insulation material may comprise a ceramic fiber material or a microporous thermal insulation material. The layer of thermal insulation material may be coated with a specular or diffuse infra-red reflecting material or may incorporate a suitable infra-red reflecting material such as titanium dioxide. The layer of thermal insulation material may be supported in a metal dish. The reflector may be a specular reflector such as a coating of a reflecting metal deposited externally or internally of the source of infra-red radiation or may be a metallic reflector positioned externally of the source of infra-red radiation. Alternatively, the reflector may be a diffuse reflector such as a layer of fine particulate alumina deposited onto the external surface of the source of infra-red radiation or may be a suitably shaped body formed of fine particulate alumina or other suitable material arranged externally of the source of infra-red radiation. According to a further aspect of the present invention there is provided an electric cooker which incorporates one or more electric heaters according to the first aspect of the present invention.

For a better understanding of the present invention and to show more clearly how it may be carried into effect reference will now be made, by way of example, to the accompanying drawings in which:

DESCRIPTION OF PRIOR ART EMBODIMENT

Figure 1:
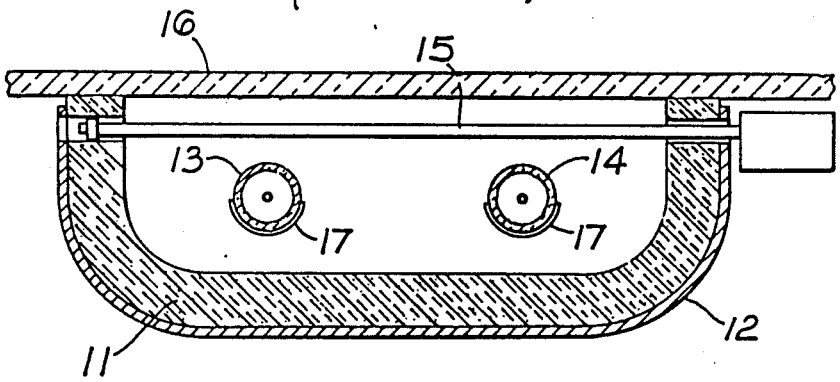
FIG. 1 is a cross-sectional view of an electric heater according to the prior art.

FIG. 1 shows a layer 11 of thermal insulation material supported in a metal dish 12. Two infra-red lamps 13, 14 are mounted above the layer 11 and a thermal cut-out device 15 passes over the lamps 13, 14. A smooth cooking surface 16 of an electric cooker extends over the heater and is conventionally made of a glass ceramic material. A reflective coating 17 is provided on the bottom half of the lamps 13, 14 in order to reflect infra-red radiation out of the heater.

DESCRIPTION OF PREFERRED EMBODIMENTS

Figure 2:
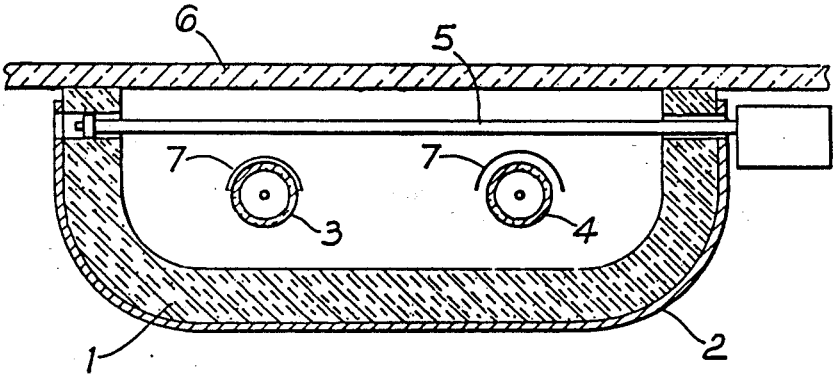
FIG. 2 is a cross-sectional view of one embodiment of an electric heater according to the present invention in which the reflector is disposed on the outer surface of the glass tube of the infra-red lamp.
Figure 6:
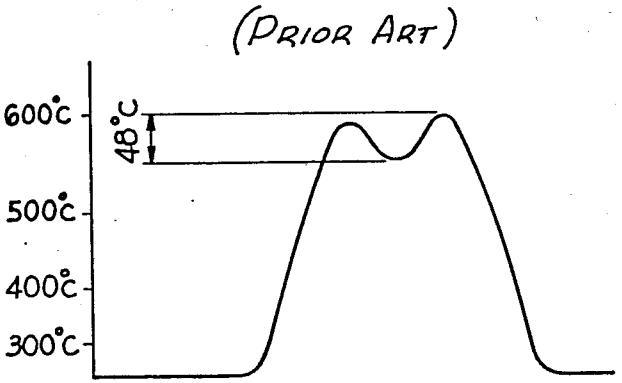
FIGS. 6 and 7 are graphs showing the temperature of a cooking surface heated by prior art electric heaters.

FIG. 2 shows a layer 1 of thermal insulation material such as ceramic fiber or microporous thermal insulation material supported in a shallow metal dish 2. Mounted above the layer 1 are two infra-red lamps 3, 4, although the number of lamps may be varied so that fewer than two or more than two may be provided. A thermal cut-out device 5 passes over the lamps 3, 4 in the illustrated embodiment, but the position of the thermal cut-out device may be varied, for example the thermal cut-out device may pass between the lamps 3, 4. A smooth cooking surface 6 of an electric cooker of which the heater forms a part extends over the heater and may be made, for example, of a glass ceramic material. In contrast with the embodiment of the prior art shown in FIG. 1, a reflective coating is not provided on the bottom half of the lamps 3, 4 so as to reflect radiation out of the heater, but on the contrary a reflector 7 is arranged on the internal face (see FIG. 3) or over the top surface (see FIG. 4) of the lamps so as to reflect infra-red radiation towards the layer 1 of thermal insulation material. The reflector 7 may be, for example, a specular reflector such as a coating or reflecting metal deposited on the inside or the outside of the quartz tube of the lamp or may be a metallic reflector positioned outside the lamp so as to reflect radiation towards the layer 1. Alternatively, the reflector 7 may be a diffuse reflector such as layer of fine particulate alumina deposited onto the outside of the tube of the lamp or a suitably shaped body formed of fine particulate alumina or other suitable material arranged outside the lamp so as to reflect radiation towards the layer 1. Because a large proportion of the infra-red radiation emitted by the lamps 3, 4 is directed towards the layer 1, the layer 1 is itself preferably a relatively good reflector of the infra-red radiation. For example, the layer 1 may be made of, or may be coated with, a diffuse reflecting material or may be coated with a specular reflecting material. However, we have found that a microporous thermal insulation which includes an opacifier, such as titanium dioxide in the form of its ore rutile, is a suitable reflecting material. The other constituents of the microporous thermal insulation material may comprise silica aerogel or pyrogenic silica and reinforcing fibers such as aluminosilicate fibres. We have found that the reflector 7, particularly if only one or two infra-red lamps are used, results in a substantially more uniform distribution of radiation from the heater. This not only increases the efficiency of the heater, but also enhances the optical appearance of the heater when it is energized beneath the cooking surface 6. FIG. 6 is a graph showing the temperature of the cooking surface 6 for the prior art embodiment shown in FIG. 1 in which a reflective coating is provided over an angle of about 165° on the bottom of the lamps. It can be seen that two temperature peaks arise, one peak above each lamp. The temperature difference between the peaks and the intermediate trough is approximately 48° C. It will be apparent that the temperature profile is taken in a direction perpendicular to the longitudinal axes of the lamps.

Figure 7:
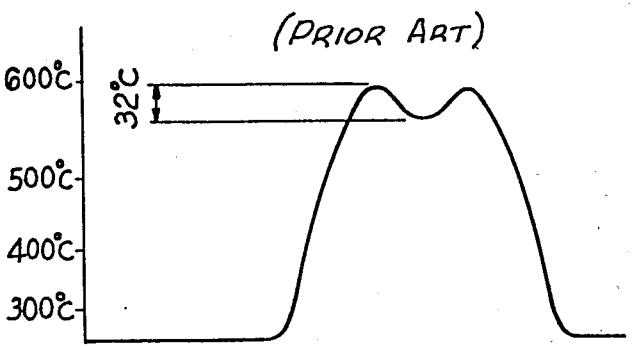

FIG. 7 is a graph similar to FIG. 3 but for an embodiment in which no reflective coating is provided either above or below the lamps. FIG. 4 shows that there are still two temperature peaks above the lamps, but that the temperature difference between the peaks and the intermediate trough is approximately 32° C.

Figure 3:
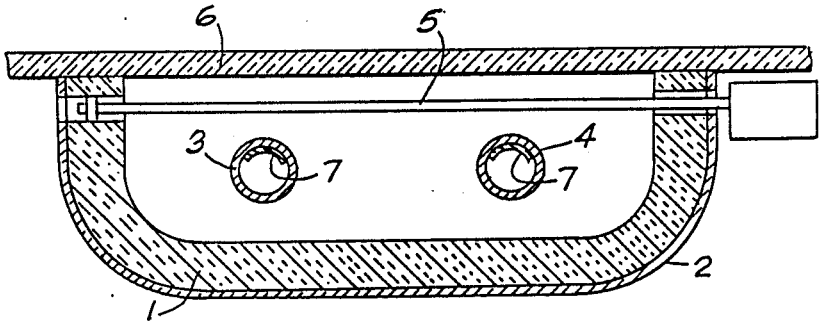
FIG. 3 is a cross-sectional view of a second embodiment of an electric heater according to the present invention in which the reflector is located on the internal face of the glass tube of the infra-red lamp.
Figure 4:
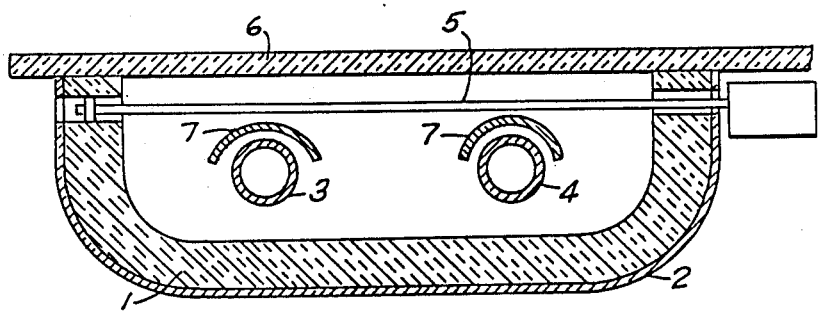
FIG. 4 is a cross-sectional view of a third embodiment of an electric heater according to the present invention in which the reflector is located above the outer surface of the glass tube of the infra-red lamp.
Figure 5:
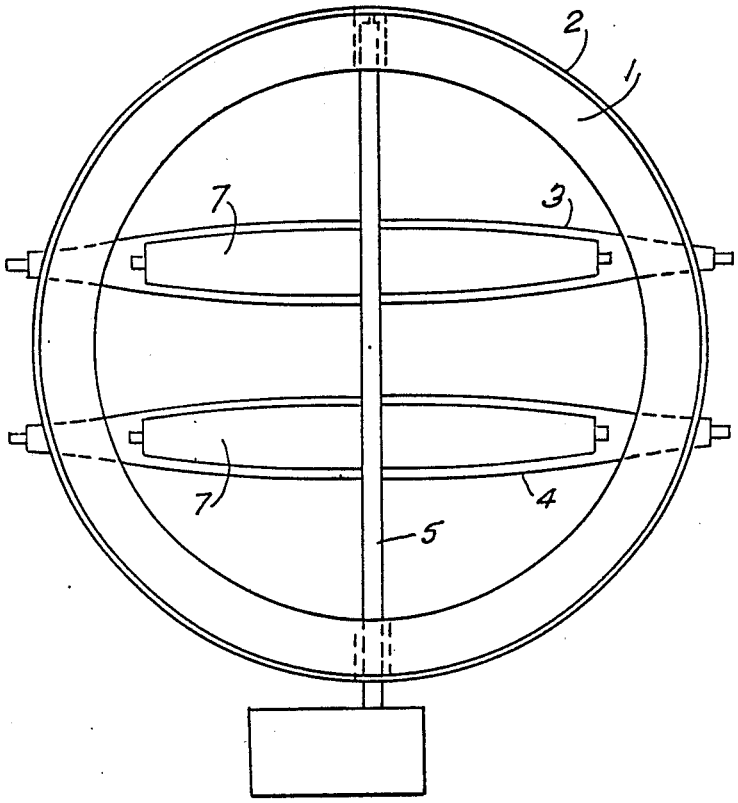
FIG. 5 is a top view of the electric heater assembly of the present invention showing the dish-shaped profile and the mountings for the components of the electric heater assembly.
Figure 8:
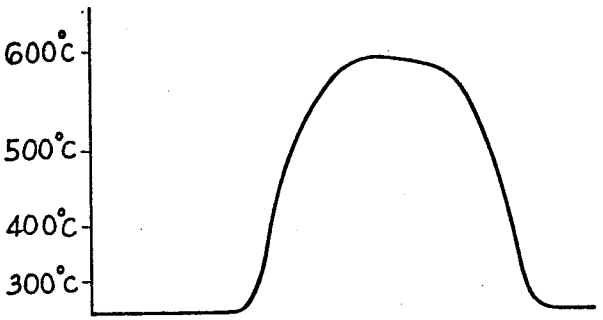
FIGS. 8 and 9 are graphs showing the temperature of a cooking surface heated by elecric heaters according to the present invention.

FIG. 8 is a graph similar to FIG. 6 but for the embodiment according to the present invention shown in FIG. 2–4 in which a reflective coating is provided over an angle of about 165° on the upper portion of the lamps as shown in FIG. 2–4. It can be seen from FIG. 8 that in this embodiment according to the present invention the temperature profile does not reveal any peaks above the lamps.

Figure 9:
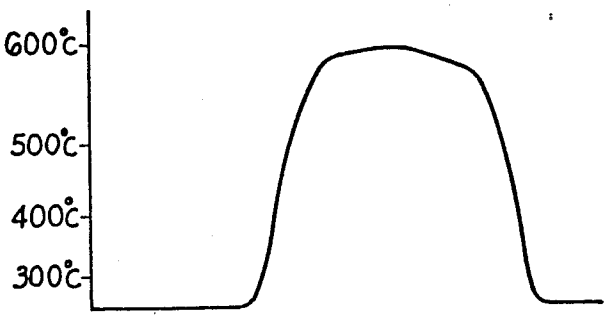

In the graph shown in FIG. 9 the temperature profile is similar to the temperature profile of FIG. 8, but the reflective coating is provided only over an angle of 90° on the upper portion of the lamps. The temperature profile shown in FIG. 9 is wider and generally flatter than that shown in FIG. 8 and there is an indication of a temperature peak on the cooking surface at a point between the lamps. The heaters used to produce the temperature profiles of FIGS. 6 to 9 had a heated diameter of 145 mm with two 600 watt infra-red lamps arranged parallel with each other and positioned between a microporous thermal insulation base and a glass ceramic cooking surface. With regard to the temperature profile shown in FIG. 9, a coating applied over an angle of 90° may not in all cases be preferably to any other angle, but the optimum coating angle will depend on the configuration of the heater and on the nature of the cooking surface. In the illustrated embodiment the axes of the lamps were 60 mm apart and the cooking surface was a brown glass ceramic manufactured by Corning Glass Works, Corning, N.Y., U.S.A.

I claim:

1. An electric cooker which comprises:

a smooth cooking surface; and at least one electric heater mounted beneath said smooth cooking surface and comprising:

a dish;

a layer of thermal insulation material supported in said dish;

at least one source of infra-red radiation in the form of an infra-red lamp supported between said layer of thermal insulation material and said cooking surface;

a thermal cut-out device; and at least one respective reflector positioned to intercept infra-red radiation emitted by each said source in a direction towards said smooth cooking surface, and to reflect said infra-red radiation in a direction towards said layer of thermal insulation material.

2. An electric cooker according to claim 1, wherein said layer of thermal insulation material comprises ceramic fiber material.

3. An electric cooker according to claim 1, wherein said layer of thermal insulation material comprises a microporous thermal insulation material.

4. An electric cooker according to claim 1, wherein said layer of thermal insulating material incorporates an infra-red reflecting material comprising titanium dioxide.

5. An electric cooker according to claim 1, wherein said at least one reflector comprises a specular reflector.

6. An electric cooker according to claim 5, wherein said at least one reflector comprises a metallic reflector positioned adjacent to each of said at least one source of infra-red radiation.

7. An electric cooker according to claim 1, wherein said at least one reflector comprises a diffuse reflector.

8. An electric cooker according to claim 7, wherein said at least one reflector comprises a shaped body formed of fine particulate alumina positioned adjacent to each of said at least one source of infra-red radiation.

9. An electric cooker according to claim 15, wherein each of said at least one infra-red lamp includes a tube, and wherein said at least one reflector comprises a coating of a reflecting metal deposited internally of said tube.

10. An electric cooker according to claim 15, wherein each of said at least one infra-red lamp includes a tube, and wherein said at least one reflector comprises a layer of fine particulate alumina deposited onto the external surface of said tube.

11. The cooker of claim 1, comprising a plurality of said sources, each having its respective reflector formed directly on a surface thereof facing said cooking surface.

12. The cooker of claim 11, said reflector being formed one each said source over at least 90° of a portion thereof facing said cooking surface.

13. The cooker of claim 12, each said source having said reflector formed over at least 165° of said portion thereof.

14. The cooker of claim 1, comprising a pair of rows of said sources, wherein a depth of said cooker is approximately equal to the spacing between said pair of rows.

15. The cooker of claim 1, comprising a pair of rows of said sources, wherein the distance between mutually opposed respective faces of said cooking surface and of said layer of thermal insulation material is less than the spacing of said,pair of rows.

16. The cooker of claim 15, said reflector being formed on each said source over at least 90° of a portion thereof facing said cooking surface.

17. The cooker of claim 16, each said source having said reflector formed over at least 165° of said portion thereof.

18. The cooker of claim 1, said at least one source consisting of a single source, said respective reflector formed directly over at least 90% of a top surface of said source.

19. The cooker of claim 1, comprising a pair of rows of said sources, without having a dip in the heat distribution waveform at said smooth cooking surface between said pair of rows.

* * * * *